US005791643A

United States Patent [19]

Bumgardner et al.

[11] Patent Number: 5,791,643

[45] Date of Patent: Aug. 11, 1998

[54] INSERT FEEDING APPARATUS

[75] Inventors: Jack Bumgardner; James L. Feldman, both of Warsaw, Ind.

[73] Assignee: R.R. Donnelley & Sons Company, Lisle, Ill.

[21] Appl. No.: 782,734

[22] Filed: Jan. 13, 1997

[51] Int. Cl.[6] ..... B65H 39/02

[52] U.S. Cl. ..... 270/58.08; 271/3.01

[58] Field of Search ..... 270/58.01, 58.07, 270/58.08, 58.11; 271/3.01, 152, 157, 147, 149; 414/795.8, 416, 417, 430, 330, 391, 392, 798.8

[56] References Cited

U.S. PATENT DOCUMENTS

| | | | |
|---|---|---|---|
| 4,177,982 | 12/1979 | Bewersdorf et al. . | |
| 4,436,297 | 3/1984 | Chandhoke | 271/3.1 |
| 4,494,742 | 1/1985 | Guenther et al. | 270/58 |
| 4,618,136 | 10/1986 | Pessina et al. . | |
| 4,641,744 | 2/1987 | Spisak . | |
| 4,907,941 | 3/1990 | Focke et al. | 414/795.8 |
| 4,981,292 | 1/1991 | Cosgrove | 271/150 |
| 5,000,435 | 3/1991 | Godlewski . | |
| 5,092,577 | 3/1992 | Schmitz et al. | 271/11 |
| 5,114,129 | 5/1992 | Chang et al. . | |
| 5,451,040 | 9/1995 | Crabtree . | |

*Primary Examiner*—Hoang Nguyen
*Attorney, Agent, or Firm*—Marshall, O'Toole, Gerstein, Murray & Borun

[57] ABSTRACT

In order to avoid ergonomic problems such as carpet tunnel syndrome while improving productivity, an apparatus for feeding inserts such as order blanks and envelopes to a binding line is disclosed. The apparatus includes an insert support for supporting inserts in a vertically inclined stack together with an insert feeder for feeding inserts along a vertically inclined upward feed path. It also includes a transport extending from the insert feeder for transporting inserts for delivery to an insert receiving point remote therefrom. The apparatus further includes the transport having an insert receiving end positioned adjacent the top of the vertically inclined insert stack, an insert supplying end positioned adjacent the insert receiving point, and an insert conveying section extending from the insert receiving end to the insert supplying end. It also includes an insert separator which is generally operative between the insert feeder and the insert receiving end of the insert transport. As for the insert separator, it includes a vertically inclined insert drive for engaging a vertically inclined surface of the vertically inclined insert stack to facilitate separation and transfer of inserts from the stack.

30 Claims, 7 Drawing Sheets

INSERT FEEDING APPARATUS

FIELD OF THE INVENTION

The present invention is generally directed to an insert feeder and, more particularly, an apparatus for feeding inserts to a binding line.

BACKGROUND OF THE INVENTION

In recent years, many large circulation periodicals have required rapid handling of the portions of the periodicals consisting of signatures which are gathered for binding, trimmed, bundled for minimum shipping costs, and shipped. A typical operation utilizes a multitude of inserter pockets, each of which receives signatures seriatim from a signature supply means, opens each signature, and drops the signatures to successively straddle a gathering chain which runs in front of the inserter pockets and carries the complete collection of gathered signatures to a location for further handling to complete the binding process. Moreover, because of the need for highly efficient plant operations, there has been a constant effort to increase the speed at which machines operate which has required the development of new techniques for handling the signatures at all stages of the binding process.

In addition to high speed operation, many large circulation periodicals are now demanding a degree of flexibility that has heretofore been considered impossible. This is particularly true, for instance, where the periodical wishes to include one or more personalized messages or other customized information or to include inserts in the form of order blanks, envelopes, or the like, but this must be done without significant reduction in the cyclic rate of operation that would otherwise decrease plant efficiency thereby increasing costs while possibly failing to accommodate the high volume presently produced by the U.S. printing industry which requires that the most efficient possible use be made of manpower, equipment and plant space. Furthermore, since the need for inserts in the form of order blanks, envelopes or the like is sporadic, the equipment to achieve this objective should be compatible with a normal bindery line.

More specifically, the equipment to achieve this objective should, in every respect possible, operate in conjunction with conventional inserter pockets. It should also not only be quite effective but, in accordance with a growing awareness in more recent times, the equipment should avoid certain additional problems in terms of the productivity of binding lines, especially certain ergonomic problems such as carpel tunnel syndrome, that are often experienced by binding line employees. As for these problems, it will no doubt be appreciated that they exist no matter whether the employee is handling order blanks, envelopes, or other types of inserts.

Moreover, these types of problems are known to exist regardless of the technique which are utilized to feed the inserts to the binding line. Thus, it would be highly desirable to provide a new and improved apparatus for feeding inserts to a binding line in either shingled stream or one-at-a-time fashion. In addition, it would be highly desirable to further enhance the versatility as well as the productivity of insert feeding in a binding line.

For this purpose, it will be appreciated that any apparatus that was proposed necessarily had to be compatible with the limit on the space that is available in a binding line facility. In development of the present invention, it was recognized that an apparatus for feeding signatures to a binding line in a manner successfully overcoming the foregoing problems was achieved in commonly owned Chang et al. U.S. Pat. No. 5,114,129 (the teachings of which to the extent applicable are fully incorporated herein by reference) wherein it was established as a goal for the signature feeding apparatus to primarily address concerns in terms of ergonomic problems such as carpel tunnel syndrome and the like, but it was also found in solving this problem that it was possible to increase capacity for receiving stacked signatures for feeding to the binding line within the same or a similar amount of floor space while operating at high speed and accepting signatures in a variety of ways. However, with respect to inserts such as order blanks, envelopes or the like, there are different problems because such inserts do not have the sufficient rigidity to permit handling in the same manner as signatures.

The present invention is thus directed to overcoming the foregoing problems and achieving the resulting objects as established by the development of the unique insert feeding apparatus described herein.

SUMMARY OF THE INVENTION

It is a principal object of the present invention to provide an improved apparatus for feeding inserts to a binding line. It is a further object of the present invention to provide an insert feeding apparatus which may be configured to feed inserts in either shingled stream or one-at-a-time fashion wherein the apparatus accepts a high capacity of stacked inserts in a minimum amount of floor space and operates at high speed to increase productivity levels. It is an additional object of the present invention to provide an insert feeding apparatus sensitive to ergonomic problems.

Accordingly, the present invention is directed to an apparatus for feeding inserts, and in particular to a binding line, in such a manner as to achieve the foregoing objectives. The apparatus comprises means for feeding inserts along a vertically inclined upward feed path including means for supporting inserts in a vertically inclined stack. Insert transport means extending from the insert feeding means is also provided for transporting inserts for delivery to an insert receiving point remote therefrom. More specifically, the insert transport means has an insert receiving end positioned adjacent the top of the vertically inclined stack, an insert supplying end positioned adjacent the insert receiving point, and an insert conveying section extending from the insert receiving end to the insert supplying end. Insert separating means operative between the insert feeding means and the insert receiving end of the insert transport means is provided including vertically inclined insert drive means for engaging a vertically inclined surface of the insert stack. With this particular arrangement, the vertically inclined insert drive means facilitates separation and transfer of inserts from the top of the vertically inclined stack to the insert receiving end of the insert transport means.

Preferably, the insert supporting means includes a vertically inclined support surface and the insert feeding means includes an insert feeder operatively associated with a drive system to impart vertically inclined movement thereto. It is also within the present invention for the insert feeding means to include first and second insert feeders, either one of which feeds inserts at any given time to the insert transport means to be conveyed to the insert supplying end for delivery to the insert receiving point, and the insert transport means advantageously includes means for transferring inserts from the top of the vertically inclined insert stack. In this connection, the insert transferring means transfers inserts from the top of the vertically inclined insert stack to the insert supplying end for delivery to the insert receiving point in either shingled stream fashion or one-at-a-time fashion.

In the exemplary embodiment, the apparatus is particularly suited for feeding inserts to a binding line pocket. The apparatus then preferably includes a pocket interface adapted to be positioned generally adjacent a binding line for delivering inserts to the pocket for delivery to a binding line. The apparatus also preferably includes an insert supporting plate as a portion of the insert feeding means which is operatively associated with a drive system to impart vertically inclined movement thereto. In this connection, the insert supporting plate is advantageously movable from a feeding position to a position for receiving inserts directly from a source.

In addition to the foregoing, the exemplary embodiment includes an arrangement in which the insert transport means extends from the insert feeding means to the pocket interface for delivering inserts thereto. The insert transport means includes an insert receiving end positioned above the vertically inclined stack, an insert supplying end comprising the pocket interface on the side of the pocket opposite the binding line, and, as previously described, an insert conveying section extending from the insert receiving end to the insert supplying end. Additionally, the insert separating means preferably has both a vertically inclined drive section for engaging the vertically inclined insert stack and a horizontal drive section for engaging a horizontal surface of the inserts after separation from the top of the stack.

In a highly preferred embodiment, the insert feeding means includes first and second insert feeders comprising respective upper and lower feeding systems wherein the lower feeding system comprises the insert supporting plate movable from the feeding position to the position for receiving inserts directly from the source. The lower feeding system then advantageously comprises a portion of an insert receiving system for controlling the absolute position of the insert supporting plate when the lower feeding system is in the receiving position. The drive system is preferably adapted to move the insert supporting plate from a vertical upper limit in the feeding position to a vertical lower limit in the receiving position and the apparatus also includes sensing means operatively associated with the drive system. The sensing means is advantageously adjustably positioned at a preselected insert loading height intermediate the vertical upper and lower limits to cause the drive system to initially position the insert supporting plate at the preselected height. With this arrangement, the sensing means is operative to cause the drive system to lower the insert supporting plate such that the top of the inserts placed thereon is maintained at the preselected height until such time as the insert supporting plate reaches the vertical lower limit.

In this highly preferred embodiment, the apparatus preferably includes means for directing air from the vertically inclined support surface adjacent an upper extreme thereof toward the vertically inclined surface of the vertically inclined insert stack to cooperate with the insert separating means to cause separation of uppermost ones of the inserts therefrom. For this purpose, the insert separating means advantageously comprises a pair of drive belts, each having a first section generally conforming to the vertically inclined support surface and a second section extending generally horizontally away from the vertically inclined insert stack. Preferably, the drive belts are each driven upwardly and horizontally away from the vertically inclined insert stack at a suitable speed with the first and second sections of the drive belts comprising the vertically and horizontally inclined drive sections thereof, respectively.

As previously suggested, the insert receiving end of the insert transport means preferably includes shingling means adjacent the top of the vertically inclined insert stack for forming inserts into a shingled stream to be conveyed to the pocket interface. The insert conveying section of the insert transport means then advantageously includes a shingled stream conveyor leading from the shingling means to the pocket interface for conveying inserts in a shingled stream to the pocket. As also previously suggested above, the insert receiving end of the insert transport means may alternatively include separating means adjacent the top of the vertically inclined insert stack for forming inserts into a one-at-a-time stream to be conveyed to the pocket interface. The insert conveying section of the insert transport means then further includes a one-at-a-time stream conveyor leading from the separating means to the pocket interface for conveying inserts in a one-at-a-time stream to the pocket.

In a most highly preferred embodiment, the apparatus includes feeding system sensing means operatively associated with the drive systems of the upper and lower feeding systems including a first sensor at the vertical upper limit and a second sensor at a position intermediate the vertical upper limit and the vertical lower limit. The lower feeding system feeds inserts until the insert supporting plate moves vertically above the second sensor and the upper feeding system then feeds inserts while the insert supporting plate moves to the insert receiving position to receive further inserts directly from the source. The upper feeding system then feeds inserts from insert supporting fingers until they move vertically above the first sensor and the lower feeding system then moves to the feeding position so that the insert supporting plate can take over feeding inserts from the insert supporting fingers of the upper feeding system.

Preferably, the feeding system sensing means includes pressure sensitive sensing means associated with the insert supporting fingers which are carried by a mechanism for retracting the fingers responsive to a signal from the pressure sensitive sensing means. It is also advantageous for the feeding system sensing means to include a third sensor at the vertical lower limit at a predetermined distance below the second sensor wherein the third sensor is operatively associated with the drive system of the lower feeding system and the insert supporting fingers to accommodate transfer of insert feeding from one to the other of the feeding systems. Still additionally, the feeding system sensing means advantageously includes an automatic operation shut-off sensor positioned above the first sensor for terminating operation when the insert supporting fingers reach the automatic shut-off sensor.

Other objects, advantages and features of the present invention will become apparent from a consideration of the following specification taken in conjunction with the accompanying drawings.

DETAILED DESCRIPTION OF THE DRAWINGS

Figure 1:
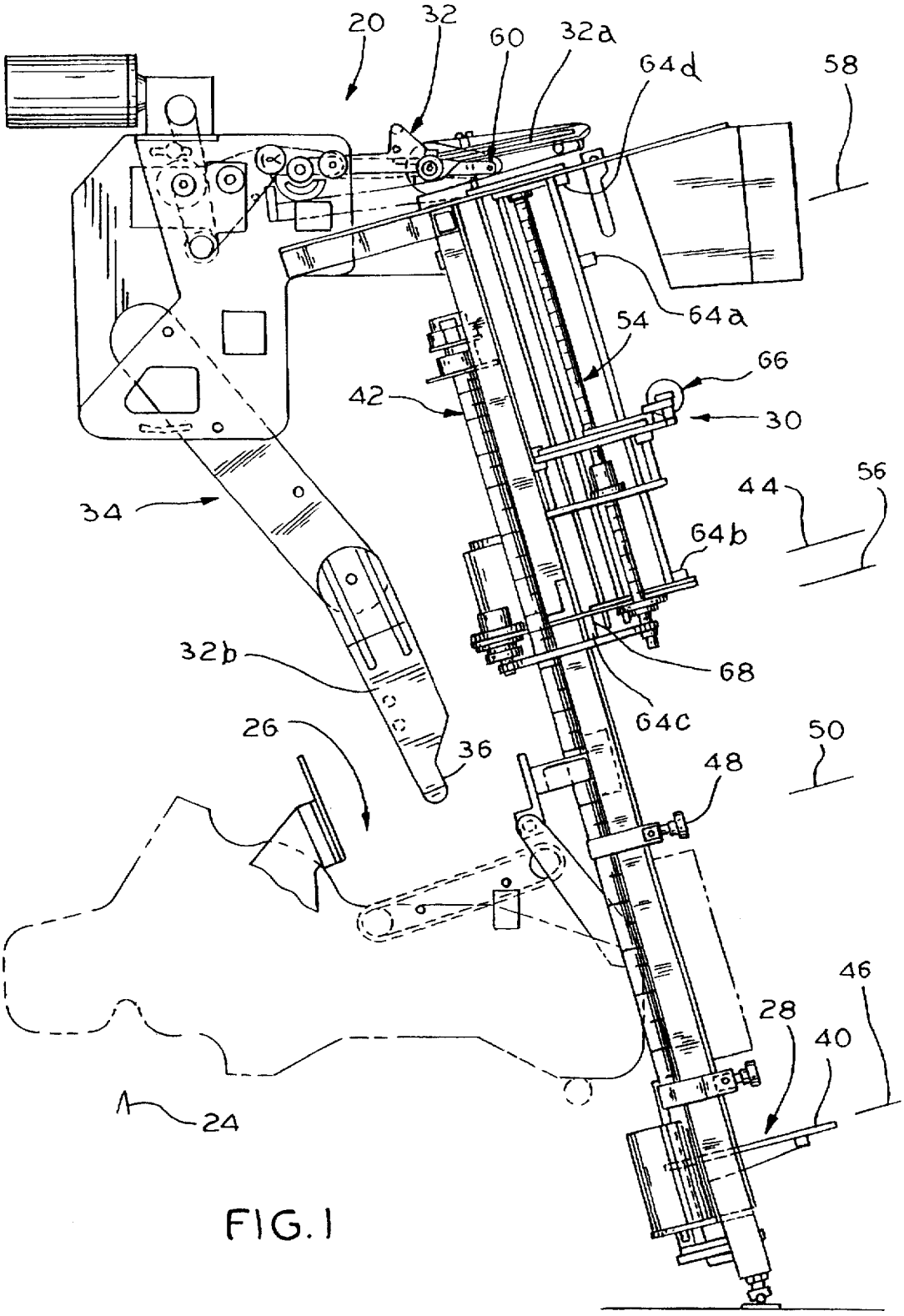
FIG. 1 is a side elevational view of an insert feeding apparatus according to the present invention.
Figure 2:
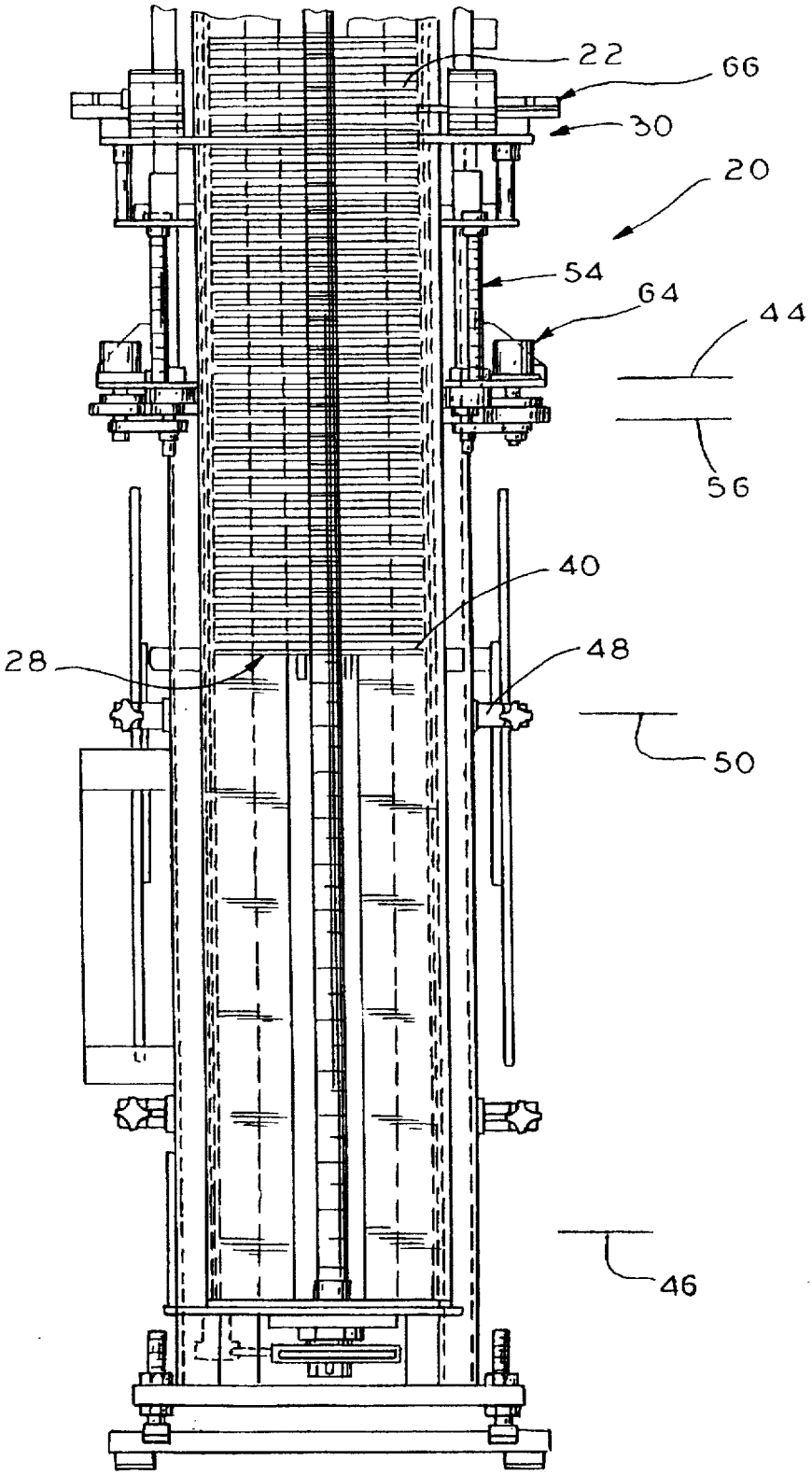
FIG. 2 is a rear elevational view of the insert feeding apparatus as more fully illustrated in FIG. 1.

In the illustrations given, and with reference first to FIGS. 1 and 2, the reference numeral 20 designates generally an apparatus for feeding inserts 22 to a binding line 24. The insert feeding apparatus 20 includes a pocket 26 adjacent the binding line 24 for receiving inserts 22 to be delivered to the binding line 24. It will also be appreciated by referring to FIG. 2 that the apparatus 20 includes first and second insert feeding means 28 and 30, respectively, for feeding inserts 22 from a source (not shown) to an insert transport means 32 (see FIGS. 1 and 5). The insert feeding apparatus 20 further contemplates at least one of the feeding means 28 being adapted to receive inserts 22 directly from the source. As will be appreciated from FIG. 1, the first and second feeding means, or insert feeders, 28 and 30 are adapted to feed inserts 22 to the insert transport means 32 in a generally vertical but slightly inclined stack along a vertically inclined upward feed path.

Referring specifically to FIG. 1, the insert transport means 32 will be understood to have an insert receiving end **32*a* positioned in spaced relation generally above the first and second insert feeders 28 and 30. It will also be appreciated that the insert receiving end 32*a* is positioned above and preferably adjacent the top of the vertically inclined stack of inserts 22 (see, also, FIG. 2), and it will further be seen that the insert transport means 32 has an insert transferring end 32*b* positioned adjacent the pocket 26 opposite the binding line 24 (see FIG. 1). Still additionally, the insert transport means 32 includes an insert conveying section 34 extending generally from the insert receiving end 32*a* to the insert supplying end 32*b*** for conveying inserts in either shingled stream or one-at-a-time fashion.

Referring to FIG. 1, the apparatus 20 includes a pocket interface 36 adjacent the binding line 24 for delivering inserts 22 to the pocket 26 for delivery to the binding line 24. It will also be appreciated from the foregoing discussion that the means for transferring inserts 22 from the top of the vertically inclined insert stack to the pocket 26 in a shingled stream fashion as at 38 (see FIG. 7) results in a certain separation of the inserts 22 whereby the insert transport means 32 may suitably be thought of as an insert separation and transfer means. As a result, the insert receiving end **32*a*** comprises an insert receiving and separating end of the insert transport means positioned above and generally adjacent the vertically inclined insert stack.

As will also be appreciated, the insert transferring end **32*b* of the insert transport means 32 is suitably positioned adjacent the pocket interface 36 on the side of the pocket 26 opposite the binding line 24**.

As will be understood by comparing FIGS. 1 and 2, at least one of the insert feeders 28 is adapted to feed inserts along a vertically inclined upward feed path from a position for receiving inserts 22 directly from the source (see FIG. 1) to a feeding position (see FIG. 2). The insert feeder 28 comprises a lower feeding system and the other of the insert feeders 30 comprises an upper feeding system with the lower feeding system 28 including an insert supporting plate 40 (see FIG. 3). A drive system 42 is operatively associated with the insert supporting plate 40. The insert supporting plate 40 further comprises a portion of an insert receiving system 43 adapted to control the absolute position of the lower feeding system 28 when in the insert receiving position (see FIG. 1). In this connection, the drive system 42 is adapted to move the insert supporting plate 40 from a vertical upper limit 44 in the insert feeding position to a vertical lower limit 46 in the insert receiving position (see FIG. 2).

Figure 3:
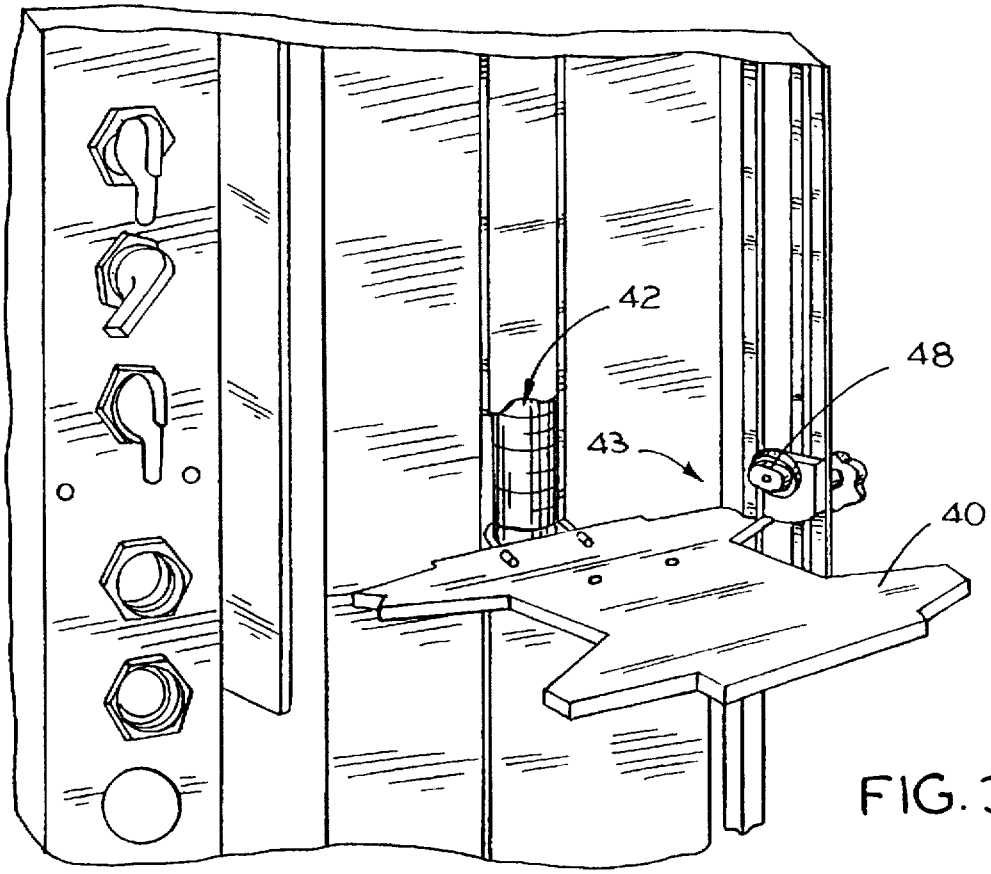
FIG. 3 is a detailed view of a portion of a lower feeding system including an insert supporting plate.

As shown in FIG. 3, the insert receiving system 43 includes sensing means 48 operatively associated with the drive system 42 for the insert supporting plate 40 which is adjustably positioned at a preselected insert loading height for an operator. This loading height is preferably intermediate the vertical upper limit 44 and the vertical lower limit 46. With regard to the sensing means 48, it causes the drive system 42 to initially position the insert supporting plate 40 at the preselected insert loading height 50 until the insert supporting plate 40 reaches the vertical lower limit 46, i.e., it bottoms out.

Figure 4:
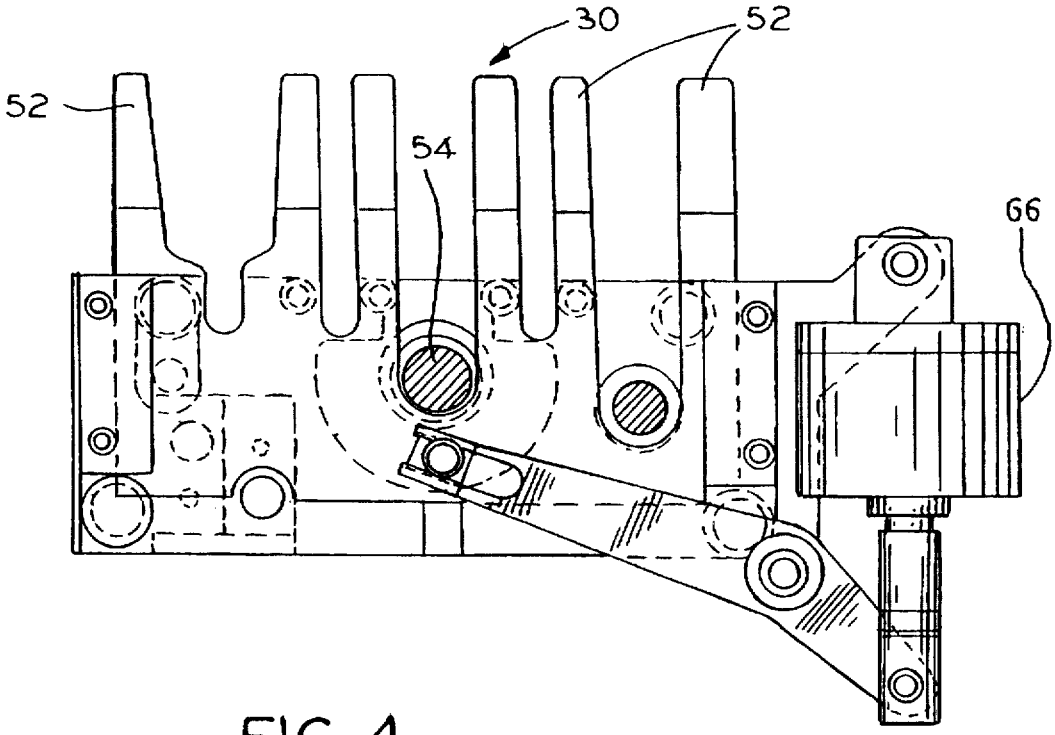
FIG. 4 is a detailed plan view of one side of an upper feeding system having insert supporting fingers.

Referring now to FIG. 4, the upper feeding system 30 includes insert supporting fingers 52 which are operatively associated with a drive system 54 for the fingers 52. It will be appreciated that the drive system 54 is separate from the drive system 42 for the insert supporting plate 40. More specifically, the drive system 54 is adapted to move the insert supporting fingers 52 from a vertical lower limit 56 to a vertical upper limit 58 in the insert feeding position.

Figure 5:
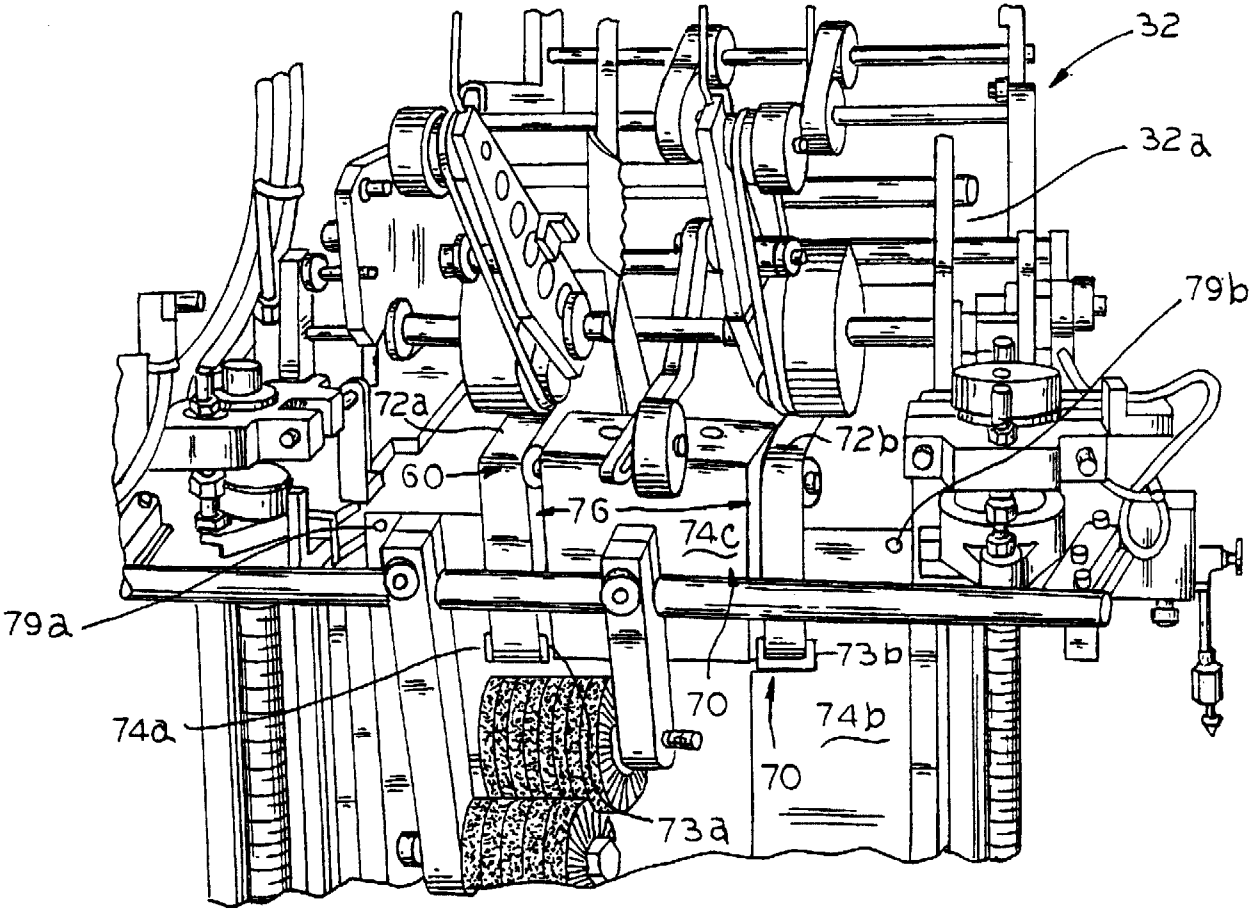
FIG. 5 is a detailed view of a portion of an insert separating means according to the present invention.
Figure 7:
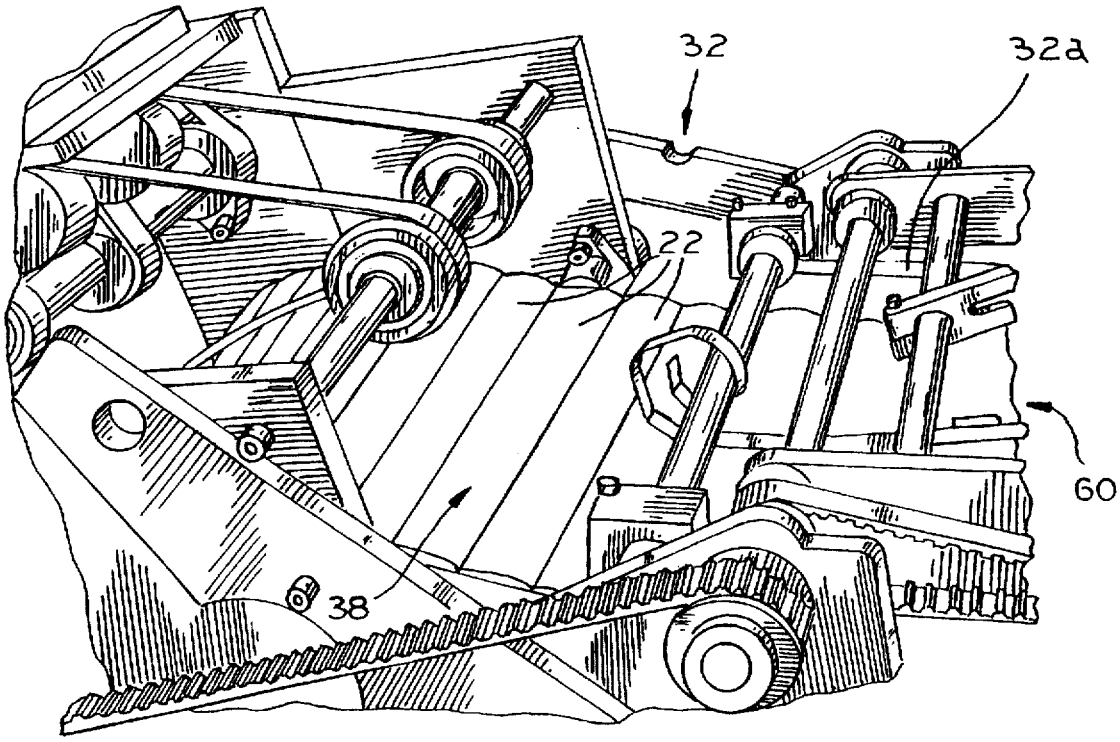
FIG. 7 is a perspective view of a portion of the insert separating means as more fully illustrated in FIG. 5.
Figure 8:
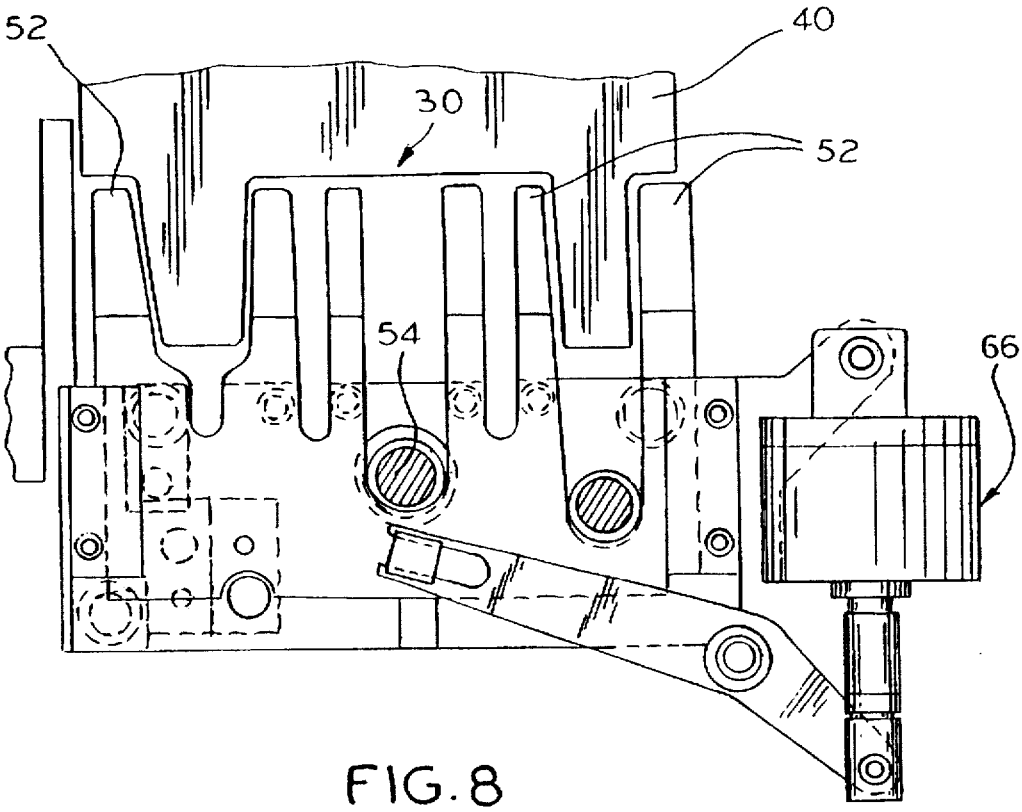
FIG. 8 is a plan view of the insert supporting plate and the insert supporting fingers according to the present invention.

Referring to FIGS. 5 and 7, the insert receiving end **32*a* of the insert transport means 32 may advantageously include shingling means 60 above and preferably adjacent the top of the vertically inclined insert stack for forming inserts 22 into a shingled stream for transfer to the pocket interface 36. The insert transport means 32 further includes a shingled stream conveyor comprising the insert conveying section 34 (see FIG. 1) which leads from the shingling means 60 to the insert supplying end 32*b* positioned adjacent the pocket interface 36 for transferring inserts 22 from the shingling means 60 in the shingled stream as at 38. Alternatively, and referring to FIG. 9, the insert receiving end 32*a* of the insert transport means 32 may include separating means 160 above and preferably adjacent the top of the vertically inclined insert stack for forming inserts 22 into a one-at-a-time stream for delivery to the pocket interface 36**.

As will be appreciated, the insert transport means 32 will thereby include means for transferring inserts 22 from the top of the vertically inclined insert stack to the insert supplying end **32*a* for delivery to an insert receiving point such as the pocket 26 in either shingled stream or one-at-a-time fashion. As will also be appreciated, depending upon whether the inserts 22 are transferred in shingled stream or one-at-a-time fashion, the insert conveying section 34 will be suitably adapted in well known fashion for conveying the inserts 22 from the insert receiving end 32*a* to the insert supplying end 32*b* for delivery to the pocket 26**.

Referring once again to FIG. 3, the insert receiving system 43 includes the receiving system sensing means 48 which is operatively associated with the drive system 42 for the insert supporting plate 40 in such manner as to adjustably position the insert supporting plate 40 at the preselected insert loading height 50 for an operator intermediate the vertical upper limit 44 and the vertical lower limit 46. Specifically, the receiving system sensing means 48 is operative to cause the drive system 42 to initially position the insert supporting plate 40 at the preselected insert loading height 50 to assist the operator in placing inserts 22 thereon when the insert supporting plate 40 is in the insert receiving position for receiving inserts 22 from the source.

Referring to FIG. 2, the insert feeding apparatus 20 also includes feeding system sensing means 64 operatively associated with the drive systems 42 and 54 of the lower and upper feeding systems 28 and 30, respectively. The feeding system sensing means 64 includes a first sensor 64*a* (see FIG. 1) at the vertical upper limit 58 and a second sensor 64*b* at a position intermediate the vertical lower limit 56 and the vertical upper limit 58. The lower feeding system 28 feeds inserts 22 until the insert supporting plate 40 moves vertically above the second sensor 64*b*. The upper feeding system 30 then feeds inserts 22 while the insert supporting plate 40 moves to the insert receiving position 50 to receive further inserts 22 which are supplied to the insert supporting plate 40 directly from the source. The upper feeding system 30 feeds inserts 22 until the insert supporting fingers 52 move vertically above the first sensor 64*a*. The lower feeding system 28 then once again moves to the insert feeding position so the insert supporting plate 40 can once again take over feeding inserts 22 from the insert supporting fingers 52 of the upper feeding system 30.

In addition, the feeding system sensing means 64 may include pressure sensitive means associated with the insert supporting fingers 52 which are carried by a retracting mechanism 66 responsive to a signal from the pressure sensitive sensing means (see FIG. 4). The feeding system sensing means 64 may alternatively include a third sensor 64*c* at the vertical lower limit 56 at a predetermined distance below the second sensor 64*b*. With this alternative arrangement, the third sensor 64*c* may then be operatively associated with the drive system 42 of the lower feeding system 28 as well as the insert supporting fingers 52 of the upper feeding system 30 to accommodate transfer of the insert feeding function.

As for the drive systems 42 and 54, they are preferably of the screw drive type. The insert supporting fingers 52 may then advantageously be carried by the retracting mechanism 66 and the third sensor 64*c* may be operatively associated with a counter 68 activated when the third sensor 64*c* senses inserts 22. With this arrangement, the counter 68 is operatively associated with the retracting mechanism 66.

More specifically, the counter 68 is preferably of the type that associates revolutions of the screw drive system 42 for the lower feeding system 28 with distance travelled. As a result, the counter 68 can activate the retracting mechanism 66 to retract the insert supporting fingers 52 when the lower feeding system 28 has travelled a predetermined distance. Specifically, the predetermined distance will be that which is sufficient to position the top of the inserts 22 carried by the lower feeding system 28 adjacent the fingers 52.

In addition to the foregoing, the feeding system sensing means 64 may also include an automatic operation shut-off sensor 64*d* positioned above the first sensor 64*a* for terminating operation of the insert feeding apparatus 20 if the insert supporting fingers 52 should reach the level of the automatic shut-off sensor 64*d*.

As a unique aspect of the present invention, the insert feeding apparatus 20 includes insert separating means 70 operative between the insert feeders 28 and 30 and the insert receiving end 32*a* of the insert transport means 32. The insert separating means 70 preferably comprises vertically inclined insert drive means in the form of driven belts 72*a* and 72*b* which are adapted to engage a vertically inclined surface of the vertically inclined stack of inserts 22 which rests upon them to facilitate the separation and transfer of inserts 22 from the top of the vertically inclined insert stack. In particular, the driven belts 72*a* and 72*b* may be disposed about idler rollers 73*a* and 73*b* to facilitate the separation and transfer of inserts 22 from the insert feeders 28 and 30 to the insert receiving end 32*a* of the insert transport means 32.

Figure 10:
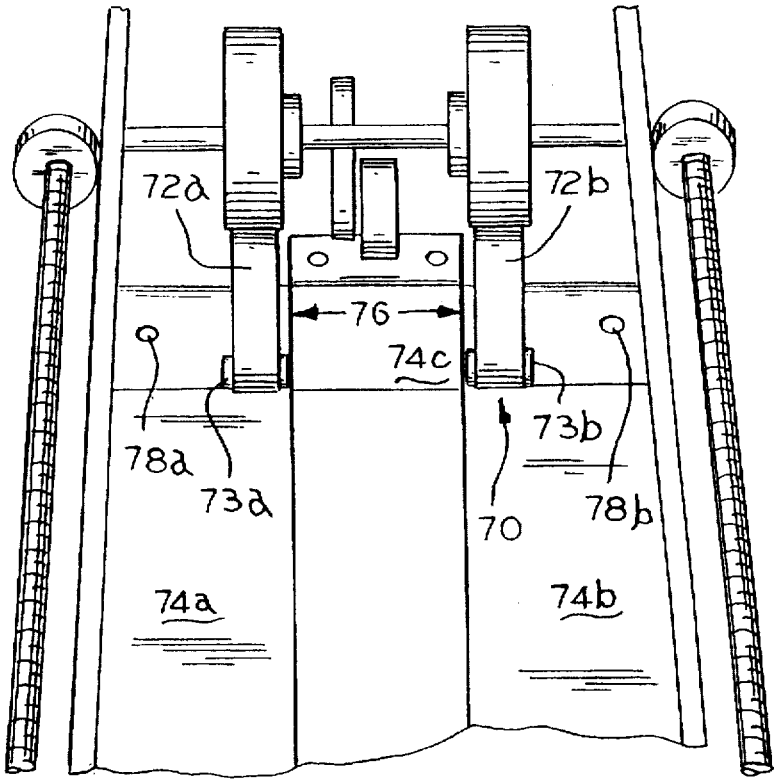
FIG. 10 is a perspective view of an insert separating means for the insert feeding apparatus of the present invention.

As shown in FIG. 10, the insert feeding apparatus 20 will be understood to have means for supporting inserts 22 in a vertically inclined stack in the form of a vertically inclined support surface or surfaces generally designated 74*a* and 74*b*. The support surfaces 74*a* and 74*b* are preferably joined by a generally coplanar vertically inclined support section 74*c* which will be seen to span the surfaces 74*a* and 74*b* at the vertically upper extent thereof. As will also be appreciated, the pair of belts 72*a* and 72*b* generally conform to the vertically inclined support surface 74*a* –74*c* for driving engagement with the vertically inclined surface of the vertically inclined insert stack resting thereupon.

As for other details of this aspect of the invention, the insert separating means operative between the insert feeders 28 and 30 and the insert receiving end 32*a* of the insert transport means 32 preferably includes a vertically inclined drive section generally designated 76 and a horizontal drive section generally designated 78. The vertically inclined drive section 76 engages the vertically inclined surface of the vertically inclined insert stack resting thereon and the horizontal drive section 78 engages a horizontal surface of the inserts 22 after separation from the top of the insert stack. Preferably, the insert separating means comprises the upwardly driven belts 72*a* and 72*b* with each of them being continuous but having a first section generally conforming to the vertically inclined support surface 74*a* –74*c* and a second section extending generally horizontally away from the vertically inclined insert stack substantially as shown in the drawings.

As for yet another unique aspect of the present invention, the insert feeding apparatus 20 includes means for directing air from the vertically inclined support surface 74*a*–74*c* adjacent an upper extreme thereof. The air directing means serves to direct air as at 79*a* and 79*b* generally horizontally toward the vertically inclined surface of the vertically inclined insert stack. In this manner, the air will be understood to cooperate with the drive belts 72*a* and 72*b* to facilitate the separation of the uppermost ones of the inserts 22 from the remainder of the stack during a feeding operation.

As previously mentioned, the belts 72*a* and 72*b* are each driven upwardly and then horizontally away from the vertically inclined insert stack with the first and second sections comprising the vertically and horizontally inclined drive sections thereof, respectively.

Figure 6:
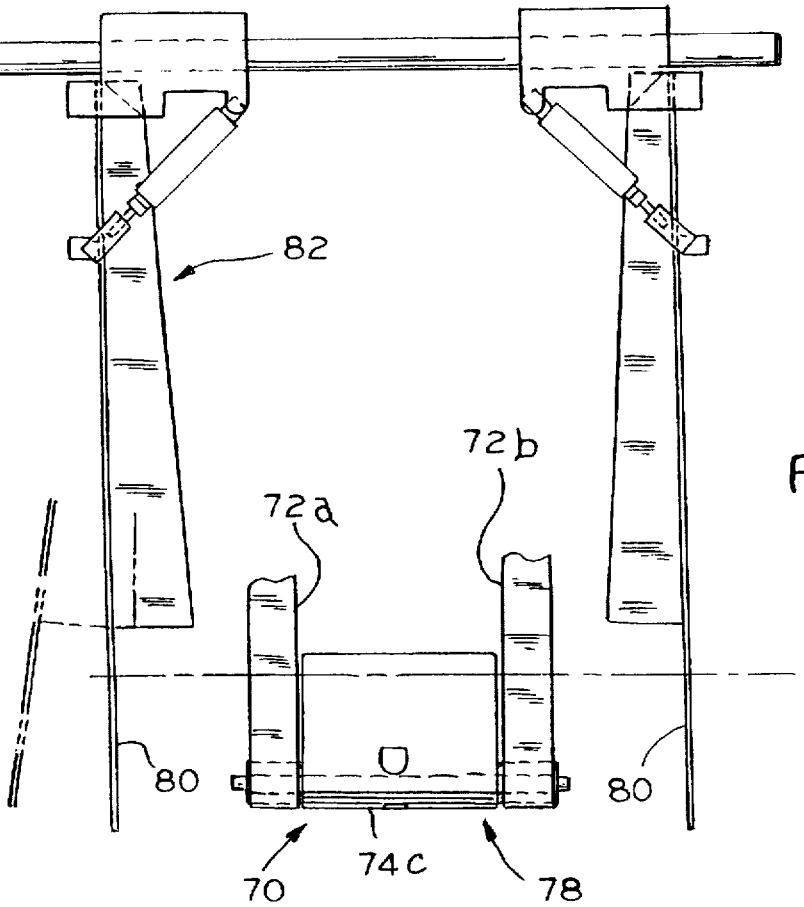
FIG. 6 is a plan view of a portion of the insert separating means as more fully illustrated in FIG. 5.

Referring to FIG. 6, the insert receiving end 32*a* of the insert transport means 32 was previously implied to include shingling means adjacent the top of the vertically inclined insert stack for forming inserts 22 into a shingled stream to be conveyed to the pocket interface 36. It will be appreciated in this connection that the shingling means advantageously comprises the horizontal drive section of the drive belts 72*a* and 72*b* positioned between each of the insert edge supports 80 for moving inserts 22 from the top of the vertically inclined insert stack to the insert conveying section 34 which then will suitably take the form of a shingled insert stream conveyor. As will also be appreciated, the shingling means may further include a jogger system 82 generally associated with the insert receiving end 32*a* of the insert transport means 32 for the purpose of straightening the inserts 22 which have been formed into the shingled stream as at 38.

Figure 9:
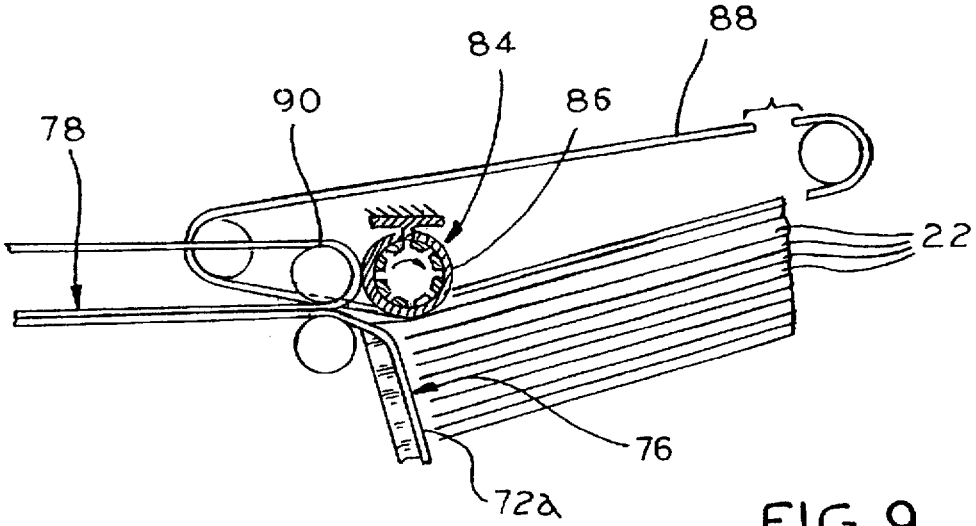
FIG. 9 is a schematic view illustrating a vacuum belt system for transferring inserts one-at-a-time.

In FIG. 9, the insert receiving end 32*a* of the insert transport means 32 may include separating means adjacent the top of the vertically inclined insert stack for forming inserts 22 into a one-at-a-time stream to be conveyed to the pocket interface 36. This may take the form of a vacuum belt system 84 in contact with the top of the vertically inclined insert stack wherein a vacuum tube roller 86 and a drive belt 88 associated with the vacuum tube roller 86 is utilized. In this connection, an upper roller 90 may cooperate with the horizontal drive section of the drive belts 72*a* and 72*b* to form the inserts 22 into a one-at-a-time insert stream to be conveyed to the pocket 26 by a one-at-a-time insert stream conveyor.

While the term "insert" has been used almost exclusively throughout, it will be understood that the inserts contemplated preferably comprise order blanks, envelopes, or the like. It will be specifically understood that the inserts are to be considered in distinction to signatures which have far more rigidity and, thus, have different handling characteristics. As for the advantages of the present invention, they are particularly significant in relation to the feeding of inserts such as order blanks and envelopes that have a limited rigidity.

While in the foregoing there has been set forth a preferred embodiment of the invention, it will be appreciated by those skilled in the art that the details herein given may be varied without departing from the true spirit and scope of the appended claims.

What is claimed is:

1. An insert feeding apparatus, comprising:

means for feeding inserts along a vertically inclined upward feed path including means for supporting inserts in a vertically inclined stack;

insert transport means extending from said insert feeding means for transporting inserts for delivery to an insert receiving point remote therefrom;

said insert transport means having an insert receiving end positioned adjacent the top of said vertically inclined insert stack, an insert supplying end positioned adjacent said insert receiving point, and an insert conveying section extending from said insert receiving end to said insert supplying end; and insert separating means operative between said insert feeding means and said insert receiving end of said insert transport means including vertically inclined insert drive means for engaging a vertically inclined surface of said vertically inclined insert stack to facilitate separation and transfer of inserts from the top of said vertically inclined insert stack from said insert feeding means to said insert receiving end of said insert transport means.

2. The insert feeding apparatus of claim 1 wherein said insert supporting means includes a vertically inclined support surface and said insert feeding means includes an insert feeder operatively associated with a drive system to impart vertically inclined movement thereto.

3. The insert feeding apparatus of claim 1 wherein said insert feeding means includes first and second insert feeders either one of which feeds inserts at any given time to said insert transport means to be conveyed to said insert supplying end for delivery to said insert receiving point.

4. The insert feeding apparatus of claim 1 wherein said insert receiving end of said insert transport means includes means for transferring inserts from the top of said vertically inclined insert stack to said insert supplying end for delivery to said insert receiving point in shingled stream fashion.

5. The insert feeding apparatus of claim 1 wherein said insert receiving end of said insert transport means includes means for transferring inserts from the top of said vertically inclined insert stack to said insert supplying end for delivery to said insert receiving point in one-at-a-time fashion.

6. An apparatus for feeding inserts to a pocket on a binding line, comprising:

a pocket interface adapted to be positioned generally adjacent a binding line for delivering inserts to said pocket for delivery to said binding line;

means for feeding inserts along a vertically inclined upward feed path including means for supporting inserts in a vertically inclined stack;

said insert supporting means including a vertically inclined support surface for said vertically inclined insert stack, said insert feeding means including an insert supporting plate operatively associated with a drive system for said plate to impart vertically inclined movement thereto, said insert supporting plate being movable from a feeding position to a position for receiving inserts directly from a source;

insert transport means extending from said insert feeding means to said pocket interface for delivering inserts thereto;

said insert transport means having an insert receiving end positioned above said vertically inclined stack, an insert supplying end comprising said pocket interface on the side of said pocket opposite said binding line, and an insert conveying section extending from said insert receiving end to said insert supplying end; and insert separating means operative between said insert feeding means and said insert receiving end of said insert transport means including a vertically inclined drive section for engaging a vertically inclined surface of said vertically inclined insert stack and a horizontal drive section for engaging a horizontal surface of said inserts after separation from the top of said vertically inclined insert stack.

7. The insert feeding apparatus of claim 6 wherein said insert feeding means includes first and second insert feeders either one of which feeds inserts at any given time to said insert transport means to be conveyed to said pocket interface for delivery to said pocket.

8. The insert feeding apparatus of claim 7 wherein said first and second insert feeders comprise respective upper and lower feeding systems, said lower feeding system including said insert supporting plate movable from said feeding position to said position for receiving inserts directly from said source.

9. The insert feeding apparatus of claim 8 wherein said lower feeding system including said insert supporting plate comprises a portion of an insert receiving system for controlling the absolute position of said insert supporting plate when said lower feeding system is in said receiving position.

10. The insert feeding apparatus of claim 9 wherein said drive system is adapted to move said insert supporting plate from a vertical upper limit in said feeding position to a vertical lower limit in said receiving position and including sensing means operatively associated with said drive system.

11. The insert feeding apparatus of claim 10 wherein said sensing means is adjustably positioned at a preselected insert loading height intermediate said vertical upper and lower limits to cause said drive system to initially position said insert supporting plate at said preselected height.

12. The insert feeding apparatus of claim 11 wherein said sensing means is operative to cause said drive system to lower said insert supporting plate such that the top of said inserts placed thereon is maintained at said preselected height until said insert supporting plate reaches said vertical lower limit.

13. The insert feeding apparatus of claim 8 wherein said upper feeding system includes insert supporting fingers operatively associated with a drive system for said fingers adapted to move said fingers from a vertical lower limit to a vertical upper limit in said feeding position.

14. The insert feeding apparatus of claim 6 wherein said insert separating means comprises a pair of upwardly driven belts generally conforming to said vertically inclined support surface for driving engagement with said vertically inclined surface of said vertically inclined insert stack.

15. An apparatus for feeding inserts to a pocket on a binding line, comprising:

a pocket interface adapted to be positioned generally adjacent a binding line for delivering inserts to said pocket for delivery to said binding line;

means for feeding inserts along a vertically inclined upward feed path including means for supporting inserts in a vertically inclined stack;

said insert supporting means including a vertically inclined support surface for said vertically inclined insert stack, said insert feeding means including an insert supporting plate operatively associated with a drive system for said plate to impart vertically inclined movement thereto, said insert supporting plate being movable from a feeding position to a position for receiving inserts directly from said source;

insert transport means generally extending from said insert feeding means to said pocket interface for delivering inserts thereto;

said insert transport means having an insert receiving end positioned above said vertically inclined stack, an insert supplying end comprising said pocket interface on the side of said pocket opposite said binding line, and an insert conveying section extending from said insert receiving end to said insert supplying end;

insert separating means operative between said insert feeding means and said insert receiving end of said insert transport means including a vertically inclined drive section for engaging a vertically inclined surface of said vertically inclined insert stack and a horizontal drive section for engaging a horizontal surface of said inserts after separation from the top of said vertically inclined insert stack; and means for directing air from said vertically inclined support surface adjacent an upper extreme thereof toward said vertically inclined surface of said vertically inclined insert stack to cooperate with said insert separating means to cause separation of an uppermost one of said inserts therefrom.

16. The insert feeding apparatus of claim 15 wherein said insert separating means comprises a pair of drive belts each having a first section generally conforming to said vertically inclined support surface and a second section extending generally horizontally away from said vertically inclined insert stack.

17. The insert feeding apparatus of claim 16 wherein said belts are each driven upwardly and horizontally away from said vertically inclined insert stack with said first and second sections comprising said vertically and horizontally inclined drive sections thereof, respectively.

18. The insert feeding apparatus of claim 15 wherein said insert receiving end of said insert transport means includes shingling means adjacent the top of said vertically inclined insert stack for forming inserts into a shingled stream to be conveyed to said pocket interface.

19. The insert feeding apparatus of claim 18 wherein said insert conveying section of said insert transport means includes a shingled stream conveyor leading from said shingling means to said pocket interface for conveying inserts in a shingled stream to said pocket.

20. The insert feeding apparatus of claim 15 wherein said insert receiving end of said insert transport means includes separating means adjacent the top of said vertically inclined insert stack for forming inserts into a one-at-a-time stream to be conveyed to said pocket interface.

21. The insert feeding apparatus of claim 20 wherein said insert conveying section of said insert transport means further includes a one-at-a-time stream conveyor leading from said separating means to said pocket interface for conveying inserts in a one-at-a-time stream to said pocket.

22. An apparatus for feeding inserts to a pocket on a binding line, comprising:

a pocket interface adapted to be positioned generally adjacent a binding line for delivering inserts to said pocket for delivery to said binding line;

means for feeding inserts along a vertically inclined upward feed path including means for supporting inserts in a vertically inclined stack;

said insert supporting means including a vertically inclined support surface for said vertically inclined insert stack, said insert feeding means including an insert supporting plate operatively associated with a drive system for said plate to impart vertically inclined movement thereto, said insert supporting plate being movable from a feeding position to a position for receiving inserts directly from said source;

insert transport means generally extending from said insert feeding means to said pocket interface for delivering inserts thereto;

said insert transport means having an insert receiving end positioned above said vertically inclined stack, an insert supplying end comprising said pocket interface on the side of said pocket opposite said binding line, and an insert conveying section extending from said insert receiving end to said insert supplying end;

insert separating means operative between said insert feeding means and said insert receiving end of said insert transport means including a vertically inclined drive section for engaging a vertically inclined surface of said vertically inclined insert stack and a horizontal drive section for engaging a horizontal surface of said inserts after separation from the top of said vertically inclined insert stack;

said insert feeding means including first and second insert feeders either one of which feeds inserts at any given time to said insert transport means to be conveyed to said pocket interface for delivery to said pocket, said first and second insert feeders comprising respective upper and lower feeding systems, said lower feeding system including said insert supporting plate operatively associated with said drive system and said upper feeding system including insert supporting fingers operatively associated with a separate drive system;

said separate drive system being adapted to move said insert supporting fingers from a vertical lower limit to a vertical upper limit in said feeding position.

23. The insert feeding apparatus of claim 22 including means for directing air from said vertically inclined support surface adjacent an upper extreme thereof toward said vertically inclined surface of said vertically inclined insert stack to cooperate with said insert separating means to cause separation of an uppermost one of said inserts therefrom.

24. The insert feeding apparatus of claim 22 including feeding system sensing means operatively associated with said drive systems of said upper and lower feeding systems including a first sensor at said vertical upper limit and a second sensor at a position intermediate said vertical upper limit and said vertical lower limit.

25. The insert feeding apparatus of claim 24 wherein said lower feeding system feeds inserts until said insert supporting plate moves vertically above said second sensor and said upper feeding system then feeds inserts while said insert supporting plate moves to said insert receiving position to receive further inserts directly from said source.

26. The insert feeding apparatus of claim 25 wherein said upper feeding system feeds inserts until said insert supporting fingers move vertically above said first sensor and said lower feeding system then moves to said feeding position so said insert supporting plate can take over feeding inserts from said insert supporting fingers of said upper feeding system.

27. The insert feeding apparatus of claim 26 wherein said feeding system sensing means includes pressure sensitive sensing means associated with said insert supporting fingers and said insert supporting fingers are carried by a mechanism for retracting said fingers responsive to a signal from said pressure sensitive sensing means.

28. The insert feeding apparatus of claim 26 wherein said feeding system sensing means includes a third sensor at said vertical lower limit at a predetermined distance below said second sensor and operatively associated with said drive system of said lower feeding system and said insert supporting fingers to accommodate transfer of insert feeding.

29. The insert feeding apparatus of claim 26 wherein said feeding system sensing means includes an automatic operation shut-off sensor positioned above said first sensor for terminating operation when said insert supporting fingers reach said automatic shut-off sensor.

30. The insert feeding apparatus of claim 22 wherein said inserts comprise order blanks and/or envelopes.

* * * * *